United States Patent [19]

Junkers

[11] 4,201,099

[45] May 6, 1980

[54] HYDRAULIC WRENCH

[76] Inventor: John K. Junkers, 7 Arrow Head La., Saddle River, N.J. 07458

[21] Appl. No.: 933,134

[22] Filed: Aug. 14, 1978

[51] Int. Cl.[2] ..... B25B 13/46

[52] U.S. Cl. ..... 81/57.39

[58] Field of Search ..... 81/57.39, 57.3

[56] References Cited

U.S. PATENT DOCUMENTS

| | | | |
|---|---|---|---|
| 1,812,816 | 6/1931 | Weaver | 81/57.39 |
| 3,745,858 | 7/1973 | Biach | 81/57.39 |
| 3,930,776 | 1/1976 | Keller | 81/57.39 |
| 4,027,561 | 6/1977 | Junkers | 81/57.39 |
| 4,079,641 | 3/1978 | Junkers | 81/57.39 |

FOREIGN PATENT DOCUMENTS

| | | | |
|---|---|---|---|
| 301266 | 9/1971 | U.S.S.R. | 81/57.39 |

*Primary Examiner*—James L. Jones, Jr.
*Attorney, Agent, or Firm*—Michael J. Striker

[57] ABSTRACT

A hydraulic wrench comprises an integrally cast housing having a first housing portion and a second elongated housing portion extending transverse to the first portion and forming a cylinder in which a piston is reciprocably mounted. A shaft extending transverse to the axis of the cylinder is turnably mounted in the first housing portion and carries at one end projecting beyond the housing an exchangeable socket for engaging a polygonal head of a threaded connector to be turned by the wrench. The shaft is turned in one direction during reciprocation of the piston over a ratchet mechanism interconnected between the piston rod and the shaft, whereby during such turning of the shaft and the connector engaged by the socket a force is created tending to turn the housing in the opposite direction. To counteract this force, a plate extending substantially parallel to the shaft is connected to the second housing portion and engages a fixed abutment adjacent the connector to be turned.

14 Claims, 4 Drawing Figures

HYDRAULIC WRENCH

BACKGROUND OF THE INVENTION

The present invention relates to hydraulic wrenches and more particularly to hydraulic wrenches which can be advantageously used for tightening and loosening threaded connectors such as nuts mounted on bolts in which a plurality of nuts which are closely adjacent to each other have to be tightened or loosened and in which the overhead clearance for applying a wrench to the nuts is rather limited, which would make it impossible to use a standard air or impact wrench.

More specifically, the present invention relates to hydraulic wrenches in which the force created during turning of a threaded connector in one direction and tending to turn the whole wrench in the opposite direction is taken up by means connected to the wrench and adapted to engage a fixed abutment adjacent to the threaded connector to be turned.

Such a hydraulic wrench is known in the art, as for instance disclosed in my U.S. Pat. No. 4,027,561.

This known hydraulic wrench has, however, certain disadvantages in that it comprises a relatively great number of parts so that this known hydraulic wrench is rather expensive to manufacture.

SUMMARY OF THE INVENTION

It is an object of the present invention to provide a hydraulic wrench which can be used for tightening or loosening threaded connectors which are closely adjacent to each other and in which the overhead space for applying a wrench is limited.

It is a further object of the present invention to provide a hydraulic wrench by means of which a large constant torque can be applied to the threaded connector which has to be tightened or loosened.

It is an additional object of the present invention to provide for a hydraulic wrench of the aforementioned kind which can be easily adapted for use of threaded connectors of different size.

It is also an object of the present invention to provide a hydraulic wrench of the aforementioned kind which is compacter than the known hydraulic wrench mentioned above so that it will stand up perfectly under extended use.

With these and other objects in view, which will become apparent as the description proceeds, the hydraulic wrench according to the present invention mainly comprises a housing having a first portion and an elongated second portion integral with said first portion and extending transverse to the latter and forming a cylinder, piston means reciprocatable in said cylinder, shaft means having an axis extending transverse to that of the cylinder and being turnably mounted in the first housing portion with an end portion of the shaft means projecting outwardly from the housing, a piston rod connected at one end to the piston means, at least one drive lever mounted in the region of one end turnable about the axis of the shaft means and pivotally connected at its other end to the other end of the piston rod, a ratchet wheel fixed to the shaft means for rotation therewith, a ratchet pawl on the drive lever and engaging the ratchet wheel to rotate the shaft means upon reciprocation of said piston means in the cylinder, exchangeable socket means mounted on the end portion of the shaft means for engaging a polygonal head of a threaded connector for turning the latter, whereby during such turning of the threaded connector in one direction a force is created tending to turn the housing about the axis of the shaft means in the opposite direction, and means connected to the second housing portion and extending laterally spaced from the shaft means substantially parallel thereto and adapted to engage a fixed abutment adjacent to the threaded connector to be turned for counteracting the aforementioned force.

The piston means preferably comprises an annular piston slidably mounted in the cylinder and a tubular member having an end portion in the cylinder and projecting from this end portion into the first housing portion, in which the annular piston is coaxially mounted on the aforementioned end portion of the tubular member and the housing includes at the junction of the first and second housing portion an annular projection in which a portion of the tubular member is slidably guided.

The piston rod may be pivotally mounted at the aforementioned one end in the end portion of the tubular member, but on the other hand, the piston rod may be fixedly connected at one end to the piston means, whereas the other end of the piston rod may be provided with a pair of trunions projecting to opposite sides of the piston rod and being engaged in elongated slots formed in a pair of drive levers arranged in the first housing portion to opposite sides of the ratchet wheel.

The second housing portion has a flat face beyond which the first housing portion projects and the means for counteracting the aforementioned force preferably comprises a plate removably connected to the second housing portion and abutting with a side face thereof against the aforementioned flat face of the second housing portion.

Preferably, the second housing portion is provided at opposite sides thereof, adjacent the aforementioned flat face, which a pair of outer ridges extending substantially parallel to the axis of the cylinder and forming a groove therebetween and the plate for counteracting the force has preferably a transverse portion engaged in the aforementioned groove and extending about one of the ridges.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
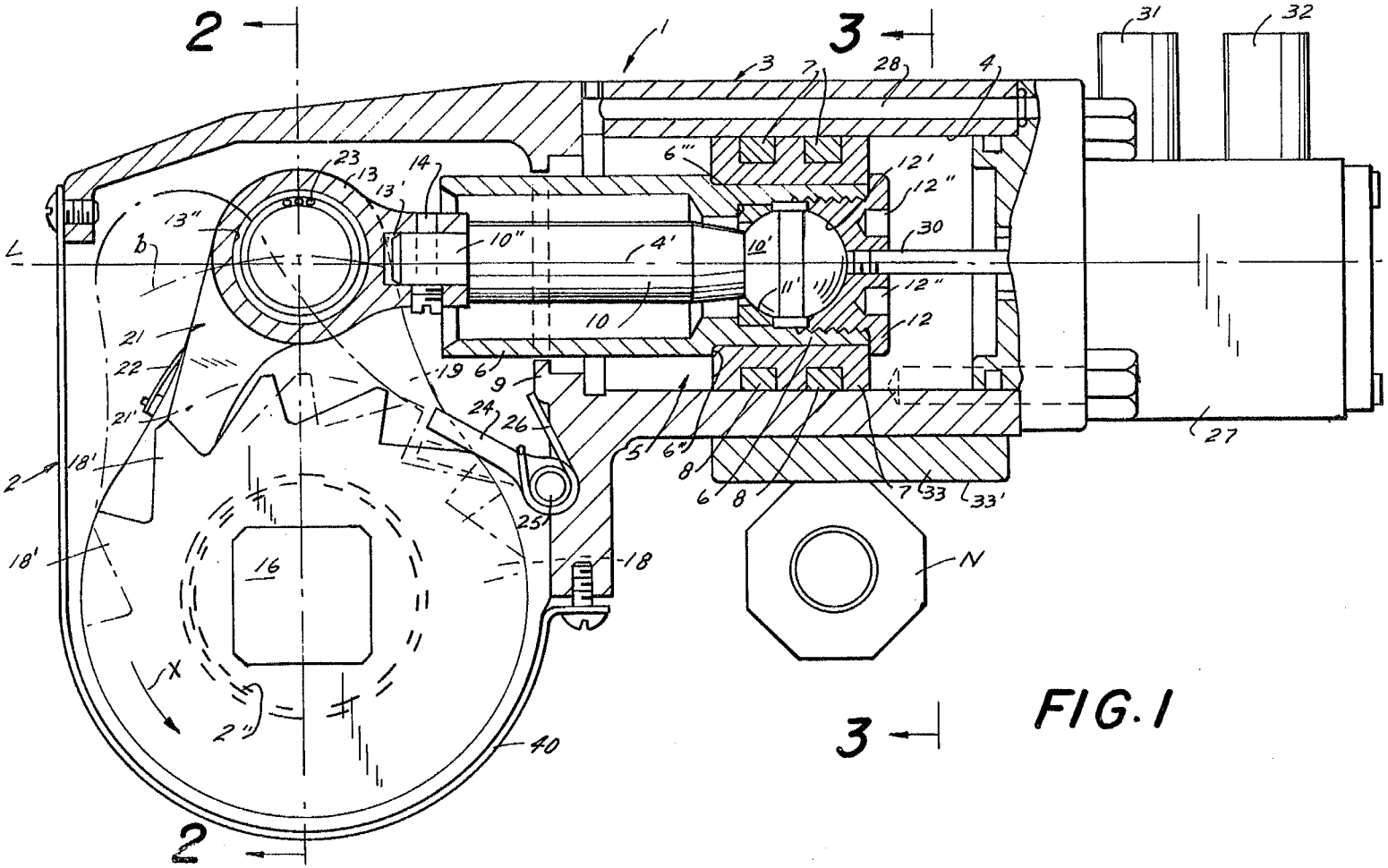
FIG. 1 is a partially sectioned top view of the wrench according to the present invention.
Figure 2:
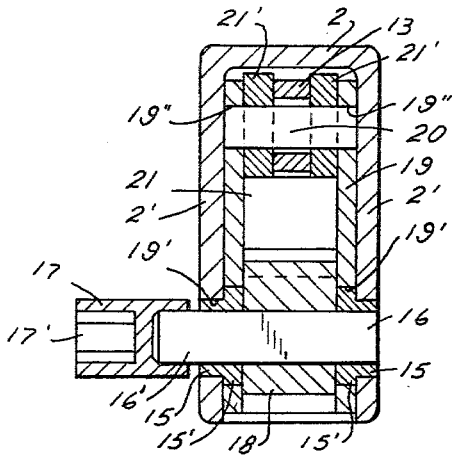
FIG. 2 is a cross-section taken along the line II—II of FIG. 1.
Figure 3:
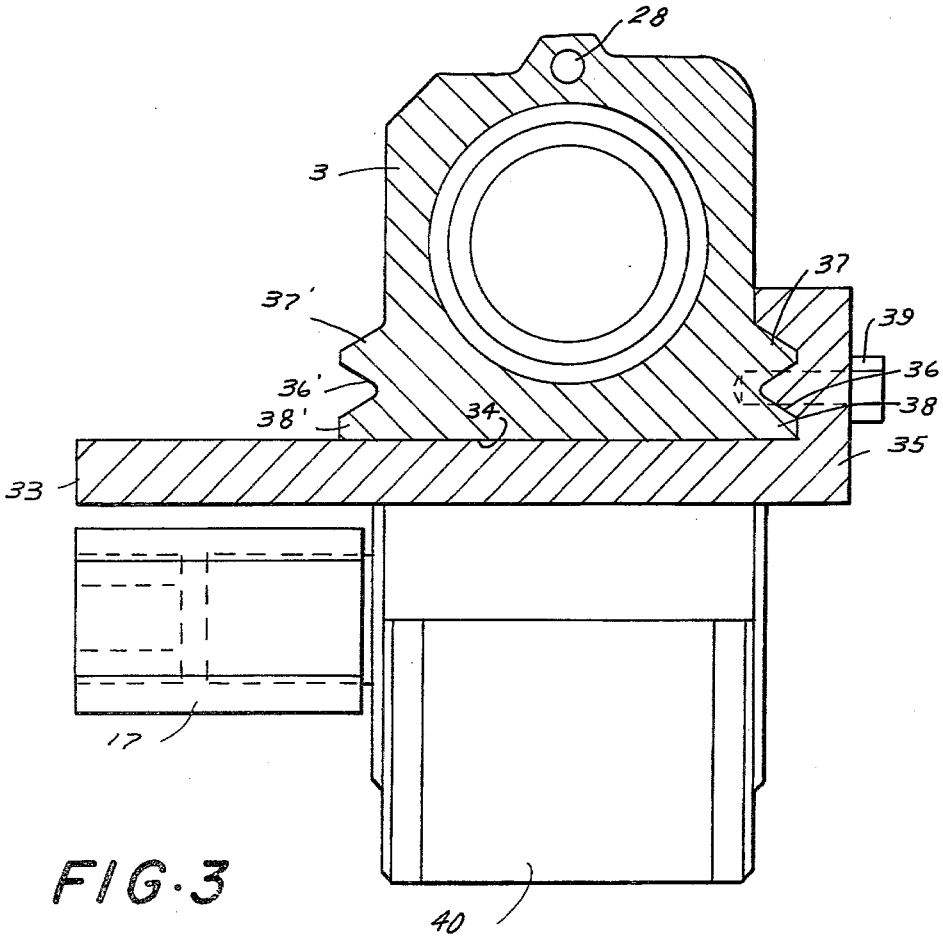
FIG. 3 is a cross-section taken along the line III—III of FIG. 1.

Referring now to the drawing, and more specifically to FIGS. 1-3 of the same, it will be seen that the hydraulic wrench according to the present invention comprises a housing 1 having a first housing portion 2 and an elongated second housing portion 3 extending transverse, that is substantially normal to the first housing portion and being formed with an elongated bore 4 therethrough forming a cylinder having an axis 4'. Piston means 5 are slidably guided in the cylinder bore 4 for reciprocation along the aforementioned cylinder axis 4'. The piston means 5 comprise a tubular member 6 having an end portion 6' located in the cylinder bore 4 and projecting from this end portion 6' into the interior of the first housing portion 2. The end portion 6' of the tubular member 6 has inner and outer peripheral surfaces respectively of a smaller diameter than the remainder of the tubular member 6 to form an outer peripheral shoulder 6'' and an inner peripheral shoulder 6'''. The piston means comprises further an annular piston 7 placed on the reduced diameter end portion 6' coaxially therewith and abutting against the outer shoulder 6''. The annular piston 7 is preferably provided on the outer peripheral surface thereof with a pair of annular grooves 7' in which sealing rings 8 are located. The housing 1 is provided at the junction of the first housing portion 2 and the second housing portion 3 with an annular inwardly extending projection 9 in which the projecting portion of the tubular member 6 is guided. In this way the piston means 5 is guided at two axially spaced portions thereof for reciprocation along the axis 4' of the cylinder bore 4. A piston rod 10 extends in longitudinal direction through the tubular member 6 of the piston means 5 and the substantially spherical end portion 10' of the piston rod 10 is pivotally connected to the end portion 6' of the tubular member 6. For this purpose a first seat member 11 is mounted in the interior of the tubular end portion 6' abutting against the inner shoulder 6'''. This seat portion has an inner surface 11' in the form of a spherical zone and engages a spherical piston rod end portion 10' on the left side of the latter, as viewed in FIG. 1, whereas the opposite side of the spherical piston rod end portion 10' is engaged by an opposite seat portion 12 having an inner part spherical surface 12' and being threadedly connected to the inner surface of the end portion 6' of the tubular member 6 of the piston means 5. The second seat portion 12 is preferably provided with a pair of transversely spaced blind bores 12'' for engagement with a tool to facilitate threading of the second seat portion 12 into the end portion 6'. The other end 10'' of the piston rod 10 has a reduced diameter and is engaged in a bore 13' extending along the axis 4' of a connecting member 13. The connecting member 13 is formed with a second bore 13'' extending normal to the axis 4'. The connecting member 13 is fixedly connected to the end 10'' of the piston rod 10 by a screw 14 extending through aligned bores in the connecting member 13 and the end 10'' of the piston rod.

The first housing portion 2 has a pair of transversely spaced parallel side walls 2', as best shown in FIG. 2, each of which is formed with a circular opening 2'' therethrough transversely spaced from the cylinder axis 4'. A pair of sleeves 15 are respectively turnably mounted in the openings 2'' and each of the sleeves 15 having at the inner end, located inwardly of the respective wall 2', an annular flange 15' of a larger diameter than the sleeve portions in the openings 2''. Each of the sleeves 15 is formed with an inner substantially square opening therethrough in which a shaft 16 is tightly engaged projecting with one end portion 16' beyond the respective side wall 2'. An exchangeable socket 17 is releasably connected by a set screw of the like, not shown in the drawing, to the projecting end portion 16' of the shaft 16. The socket 17 is a standard socket formed at the outer end thereof with a hollow portion constructed to engage the hexagonal head of a connector to be tightened by the wrench. By exchanging the socket 17 with a socket of different size connectors of different size may be tightened and/or loosened by the wrench of the present invention.

In order to turn the square shaft 16 and the socket 17 connected thereto during the reciprocation of the piston means 5 in the cylinder bore 4, the wrench includes further a ratchet wheel 18 fixed to the square shaft for rotation therewith between the flange portions 15' of the sleeves 15 and a pair of drive levers 19 provided in the region of one of the ends thereof with bores 19' in which the flange portions 15' of the sleeves 15 are respectively lodged and in the region of the other ends thereof with bores 19'' coaxially arranged with the bore 13'' of the connecting member 13. A pivot pin 20 extends through the aligned bores 13'' and 19''. The arrangement includes further a drive pawl 21 having a pair of prongs 21' respectively sandwiched, as best shown in FIG. 2, between the drive levers 19 and the connecting member 13 and the drive pawl 21 has a lower end 21'' adapted to engage the teeth 18' of the ratchet wheel 18. A leaf spring 22 connected to one of the drive levers 19 engages the drive pawl 21 for keeping the latter in engagement with a respective tooth 18' of the ratchet wheel 18. A needle bearing 23 may be provided in the bore 13'' of the connecting member 13 and engaging the peripheral surface of the pin 20. The arrangement includes further a holding pawl 24 pivotally mounted at one end in the housing portion 2 and adapted to engage with the free end thereof a tooth 18' of the ratchet wheel to prevent movement of the latter during the return stroke of the piston means 5. A spring 26 wound about the pivot pin 25 of the holding pawl 24 engages with opposite ends the holding pawl 24 and a portion of the housing 1 in the manner as shown in FIG. 1 to keep the holding pawl 24 in engagement with a respective tooth of the ratchet wheel 18.

The wrench includes further a valve housing 27 connected to the free end of the housing portion 3 by screws or the like and carrying in the interior thereof valve means of known construction not forming part of the present invention and therefore not shown in the drawing, for alternatingly feeding pressure fluid into the cylinder bore 4 to opposite sides of the annular piston 7 through the fluid passage 28 and another not shown in the drawing, respectively communicating with the cylinder bore 4 in the region of opposite ends of the latter. A rod 30 coaxially arranged with the axis 4' of the cylinder bore 4 is threadingly connected at one end to the seat member 12 and on the other end to the valve body, not shown in the drawing, of the valve means located in the valve housing 27. A pair of connectors 31 and 32 projecting laterally from the valve housing 27 serve to connect the valve located therein to a source of pressure fluid and a tank, not shown in the drawing.

In FIG. 1 the annular piston 7 is shown in an intermediate position in the cylinder bore 4 located midways between two end positions. It will be noted that in this position, as shown in FIG. 1, the piston rod 10 coincides with the axis 4' of the cylinder bore 4 and a line a connecting the center of the pin 20 with the center of the square shaft 16 extends normal to the aforementioned axis of the piston rod 10 so as to provide the maximum torque to the square shaft. During reciprocation of the piston means 5 between the two end positions thereof the center of the pin 20 will move along an arc b having its center at the center line of the square shaft 16 so that the torque applied to the latter will vary only slightly. During reciprocation of the piston means 5 from a right end position, as viewed in FIG. 1, to a left end position, that is during the active stroke of the piston means 5, the ratchet wheel will be turned in the direction of the arrow X by engagement of the free end portion 21' of the drive pawl 21 with a respective tooth 18' of the ratchet wheel 18. During the return stroke of the piston means 5, the ratchet wheel 18 will be prevented to move in the opposite direction by the holding pawl 24 engaging a corresponding tooth of the ratchet wheel 18. During turning of the shaft 16 and the socket 17 connected thereto and corresponding tightening or loosening of a threaded connector engaged in the socket 17, a force will be created tending to turn the housing 1 in a direction opposite to the direction indicated by the arrow X.

To counteract this force a plate 33 is connected to the second housing portion 3 abutting with a side face thereof against a flat side face 34 of the second housing portion 3 and having at one end a portion 35 extending transverse to the plate 33 and engaging into a groove 36 located between two ridges 37 and 38 extending parallel to the longitudinal axis 4' of the cylinder bore 4 adjacent to the flat face 34. The transverse portion 35 is connected by one or a plurality of screws 39 to the second housing portion 3. As shown in FIG. 3 the housing portion 3 is also provided at the other side thereof with a corresponding groove 36' located between two ridges 37' and 38' so that the position of the plate 33 together with that of the projecting shaft portion may be reversed. The plate 33 is arranged to abut with the outer side face 33' thereof against a stationary abutment, which may be for instance a nut N adjacent to the threaded connector to be tightened so as to counteract the force tending to turn the wrench in a direction opposite to the direction indicated by the arrow X during tightening or loosening a threaded connector engaged in the socket 17.

The wrench includes further a curved sheet metal cover 40 connected to the first housing portion 2 by screws as shown in FIG. 1 to prevent dust or foreign particles to penetrate into the interior of the housing.

Figure 4:
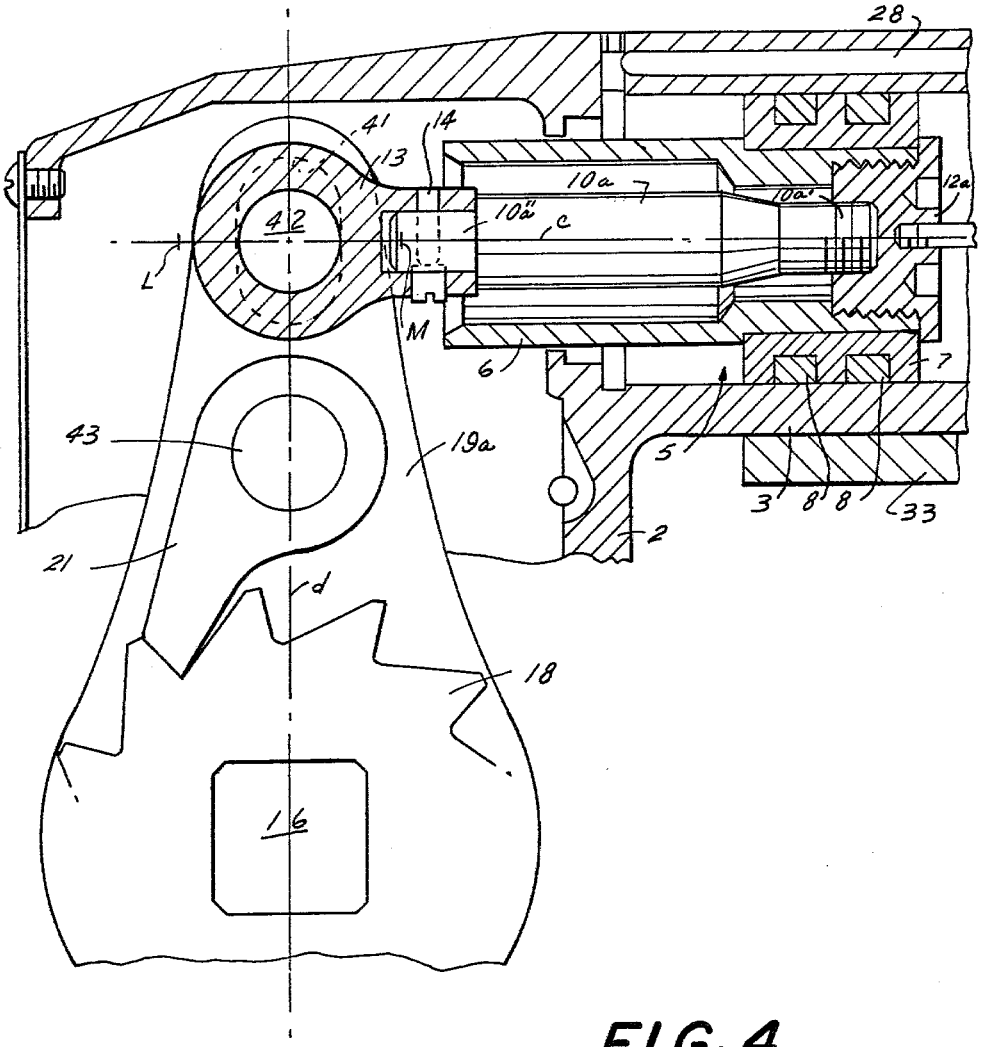
FIG. 4 is a partial section similar to FIG. 1 and showing a modification of the hydraulic wrench according to the present invention.

FIG. 4 illustrates a modification of the above-described hydraulic wrench illustrated in FIGS. 1–3. The modification shown in FIG. 4 differs from the abovedescribed modification illustrated in FIGS. 1–3 mainly in that a piston rod **10*a* is not pivotally mounted on its right end between the two seat portions 11 and 12, but in this modification, the right end 10*a'* of the piston rod 10*a* is screwed into a plug 12*a* which in turn is screwed into the right end of the tubular member 6. The left end 10*a''* of the piston rod 10*a* is again connected by a pin 14 to the connecting member 13 which carries in a bore thereof extending normal to the axis c of the piston rod 10*a* a pin 42 which is engaged at opposite ends in elongated openings 41 respectively formed in the upper region of a pair of drive levers 19*a*, only the rear one being shown in FIG. 4. These elongated openings 41 extend substantially in the direction of the axis d of the drive levers 19*a*. In this construction the drive levers 19*a* have to be longer than the drive levers 19 shown in FIGS. 1 and 2 since the drive pawl 21 is carried on a separate pin 43 extending parallel to the pin 42 through bores in the drive lever located laterally spaced from the elongated openings 41. In this construction the center of the pin 42 will move during reciprocation of the piston means 5 between its two end positions along a straight line between the points L and M located along the center line c of the piston rod 10*a*. It will therefore be evident that the torque applied to the square shaft 16 during operation of the wrench will remain constant which is a decisive advantage of the modification shown in FIG. 4 as compared with the first-described modification in which the torque will vary slightly. Of course, the modification shown in FIG. 4 includes also a plate 33 connected to the second housing portion 3 in the manner as described in connection with the embodiment shown in FIGS. 1–3 for counteracting a force tending to turn the housing 1 of the wrench in a direction opposite to the direction a threaded connector engaged by the socket 17** is turned during the operation of the wrench.

In both modifications the second housing portion forms a torque reaction box.

It will be understood that each of the elements described above, or two or more together, may also find a useful application in other types of hydraulic wrenches differing from the types described above.

While the invention has been illustrated and described as embodied in a hydraulic wrench provided with means for counteracting a force tending to turn the hydraulic wrench during operation in a direction opposite to the direction a threaded connector is turned by the wrench, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic wrench comprising a housing having a first housing portion and an elongated second housing portion extending transverse to said first housing portion and forming a cylinder having an axis extending in the longitudinal direction of said second housing portion; piston means reciprocatable in said cylinder; shaft means having an axis extending transverse to that of said cylinder and being turnably mounted in said first housing portion with an end portion of said shaft means projecting outwardly from said housing; a piston rod connected at one end to said piston means; at least one drive lever mounted in the region of one end turnable about the axis of the shaft means and being pivotally connected at the other end thereof to the other end of said piston rod; a ratchet wheel fixed to said shaft means for rotation therewith; a ratchet pawl on said drive lever and engaging the ratchet wheel to rotate said shaft means upon reciprocation of said piston means in said cylinder; exchangeable socket means mounted on said end portion of said shaft means for engaging a polygonal head of a threaded connector for turning the latter, whereby during such turning of the threaded connector in one direction a force is created tending to turn said housing about the axis of said shaft means in the opposite direction; and means connected to said second housing portion and extending laterally spaced from said shaft means substantially parallel thereto and adapted to engage a fixed abutment adjacent to the threaded connector engaged in said socket means for counteracting said force.

2. A hydraulic wrench as defined in claim 1, wherein said drive lever extends substantially normal to said piston rod.

3. A hydraulic wrench as defined in claim 2, wherein two drive levers are provided respectively arranged at opposite sides of said ratchet wheel.

4. A hydraulic wrench as defined in claim 1, wherein said piston means comprises an annular piston slidably mounted in said cylinder and a tubular member having an end portion in said cylinder and projecting from said end portion into said first housing portion, said annular piston being coaxially mounted on said end portion of said tubular member, said housing including at the junction of said first and said second housing portion an annular projection in which a portion of said tubular member is slidably guided.

5. A hydraulic wrench as defined in claim 4, and including means for pivotally mounting said one end of said piston rod in said end portion of said tubular member.

6. A hydraulic wrench as defined in claim 4, wherein two drive levers are provided respectively arranged at opposite sides of said ratchet wheel, each of said drive levers being provided in the region of the other end therewith with an elongated slot extending substantially in the longitudinal direction of the respective drive lever, and including a pin fixed to the other end of said piston rod extending substantially normal thereto and having opposite end portions respectively engaged in the elongated slots provided in said drive levers for pivotally connecting said piston rod to said drive levers.

7. A hydraulic wrench as defined in claim 6, and including a member fixed to and closing the tubular member at said one end portion thereof, the one end of the piston rod being fixedly connected to said member.

8. A hydraulic wrench as defined in claim 1, wherein said second housing portion has a flat face, said first housing portion projecting beyond said flat face and having a pair of parallel walls respectively provided with openings therethrough aligned along an axis normal to the axis of said piston means, and including means turnably mounting said shaft means in said aligned openings.

9. A hydraulic wrench as defined in claim 8, wherein said means for counteracting said force comprises a plate removably connected to said second housing portion and abutting with a side face thereof against said flat face.

10. A hydraulic wrench as defined in claim 9, wherein said second housing portion is provided at opposite sides thereof adjacent said flat face with a pair of outer ridges extending substantially parallel to the axis of said cylinder and forming a groove therebetween, said plate having a transverse portion engaged in said groove and extending about one of said ridges.

11. A hydraulic wrench as defined in claim 1, wherein said first and second housing portions are constituted by an integral casting.

12. A hydraulic wrench as defined in claim 1, and including a holding pawl pivotally mounted in said first housing portion and adapted to engage said ratchet wheel for preventing turning of the latter in a direction opposite to the direction it is turned by said drive pawl.

13. A hydraulic wrench comprising an integral cast housing having a first housing portion and a second housing portion extending transverse to said first housing portion and forming a torque reaction box, said second housing portion having a cylinder bore having an axis; piston means reciprocatable in said cylinder bore of said torque reaction box; a shaft turnably mounted in said first housing portion extending transverse to said axis of said cylinder bore and having an end portion projecting beyond said housing; an exchangeable socket connected to said end portion of said shaft; means including a ratchet drive between said piston and said shaft for turning a threaded connector having a polygonal head engaged in said socket during movement of said piston in said cylinder bore, whereby during such turning of the threaded connector in one direction a force is created tending to turn said housing about the axis of said shaft in the opposite direction; and means on said second housing portion forming said torque reaction box and adapted to engage a fixed abutment adjacent to the threaded connector to be turned for counteracting said force.

14. A hydraulic wrench as defined in claim 13, wherein said means for counteracting said force comprise a plate connected to said second housing portion and extending laterally spaced from said shaft substantially parallel thereto.

* * * * *

US004201099B1

REEXAMINATION CERTIFICATE (2142nd)

United States Patent [19]

Junkers

[11] B1 4,201,099

[45] Certificate Issued Dec. 7, 1993

[54] HYDRAULIC WRENCH

[76] Inventor: John K. Junkers, 7 Arrow Head La., Saddle River, N.J. 07458

Reexamination Request:
No. 90/002,889, Nov. 9, 1992

Reexamination Certificate for:

| | |
|---|---|
| Patent No.: | **4,201,099** |
| Issued: | **May 6, 1980** |
| Appl. No.: | **933,134** |
| Filed: | **Aug. 14, 1978** |

[51] Int. Cl.[5] ..... B25B 13/46
[52] U.S. Cl. ..... 81/57.39
[58] Field of Search ..... 81/57.3, 57.39

[56] References Cited

U.S. PATENT DOCUMENTS

| | | | |
|---|---|---|---|
| 2,836,090 | 5/1958 | Ray . | |
| 3,759,119 | 9/1973 | Wing . | |
| 4,079,641 | 3/1978 | Junkers | 81/57.39 |
| 4,201,099 | 5/1980 | Junkers . | |

FOREIGN PATENT DOCUMENTS

| | | |
|---|---|---|
| 107550 | 2/1955 | Fed. Rep. of Germany . |
| 2554427 | 12/1975 | Fed. Rep. of Germany . |
| 2631554 | 12/1976 | Fed. Rep. of Germany . |
| 433147 | 2/1966 | Switzerland . |

*Primary Examiner*—James G. Smith

[57] ABSTRACT

A hydraulic wrench comprises an integrally cast housing having a first housing portion and a second elongated housing portion extending transverse to the first portion and forming a cylinder in which a piston is reciprocably mounted. A shaft extending transverse to the axis of the cylinder is turnably mounted in the first housing portion and carries at one end projecting beyond the housing an exchangeable socket for engaging a polygonal head of a threaded connector to be turned by the wrench. The shaft is turned in one direction during reciprocation of the piston over a ratchet mechanism interconnected between the piston rod and the shaft, whereby during such turning of the shaft and the connector engaged by the socket a force is created tending to turn the housing in the opposite direction. To counteract this force, a plate extending substantially parallel to the shaft is connected to the second housing portion and engages a fixed abutment adjacent the connector to be turned.

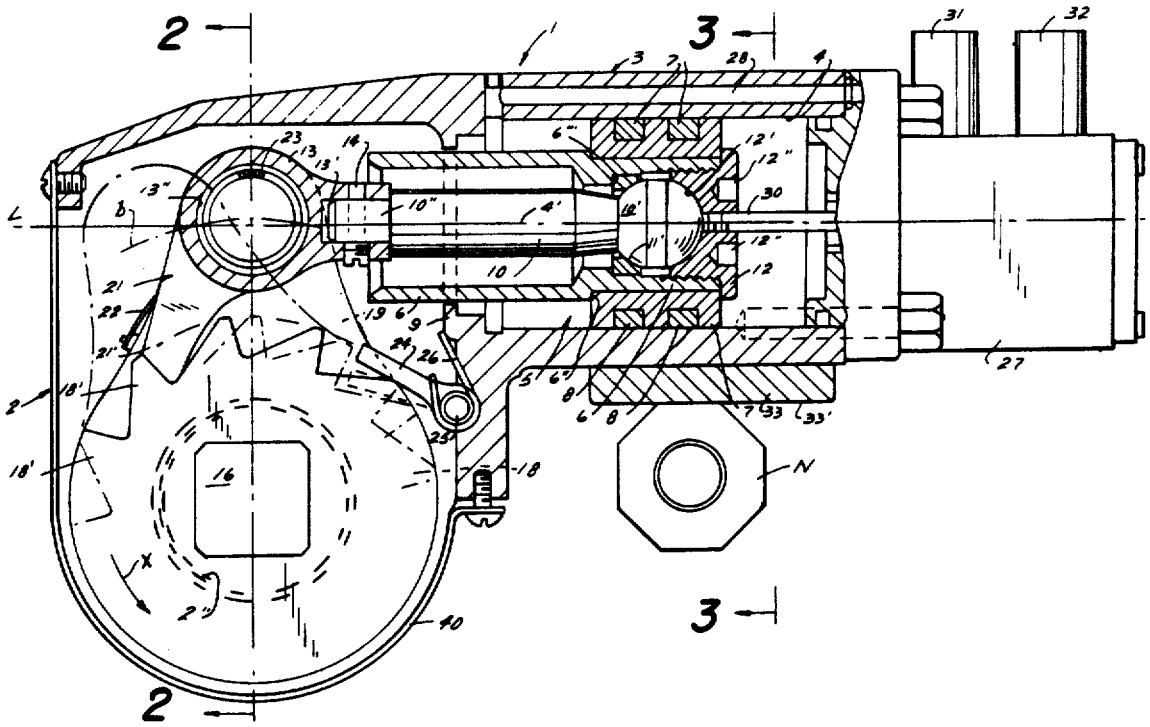

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-14 are cancelled.

New claims 15 and 16 are added and determined to be patentable.

*15. A hydraulic wrench comprising a housing having a first housing portion and an elongated second housing portion extending transverse to said first housing portion and forming a cylinder having an axis extending in the longitudinal directiton of said second housing portion; piston means reciprocatable in said cylinder; shaft means having an axis extending transverse to that of said cylinder and being turnably mounted in said first housing portion with an end portion of said shaft means projecting outwardly from said housing; a piston rod connected at one end to said piston means; at least one drive lever mounted in the region of one end turnable about the axis of the shaft means and being pivotally connected at the other end thereof to the other end of said piston rod; a ratchet wheel fixed to said shaft means for rotation therewith; a ratchet pawl on said drive lever and engaging the ratchet wheel to rotate said shaft means upon reciprocation of said piston means in said cylinder; exchangeable socket means mounted on said end portion of said shaft means for engaging a polygonal head of a threaded connector for turning the latter, whereby during such turning of the threaded connector in one direction a force is created tending to turn said housing about the axis of said shaft means in the opposite direction; and means connected to said second housing portion and extending laterally spaced from said shaft means substantially parallel thereto and adapted to engage a fixed abutment adjacent to the threaded connector engaged in said socket means for counteracting said force, said piston means comprising an annular piston slidably mounted in said cylinder and a tubular member having an end portion in said cylinder and projecting from said end portion into said first housing portion, said annular piston being coaxially mounted on said end portion of said tubular member said housing including at the junction of said first and said second housing portion an annular projection in which a portion of said tubular member is slidably guided.*

*16. A hydraulic wrench comprising a housing having a first housing portion and an elongated second housing portion extending transverse to said first housing portion and forming a cylinder having an axis extending in the longitudinal direction of said second housing portion; piston means reciprocatable in said cylinder; shaft means having an axis extending transverse to that of said cylinder and being turnably mounted in said first housing portion with an end portion of said shaft means projecting outwardly from said housing; a piston rod connected at one end to said piston means; at least one drive lever mounted in the region of one end turnable about the axis of the shaft means and being pivotally connected at the other end thereof to the other end of said piston rod; a ratchet wheel fixed to said shaft means for rotation therewith; a ratchet pawl on said drive lever and engaging the ratchet wheel to rotate said shaft means upon reciprocation of said piston means in said cylinder; exchangeable socket means mounted on said end portion of said shaft means for engaging a polygonal head of a threaded connector for turning the latter, whereby during such turning of the threaded connector in one direction a force is created tending to turn said housing about the axis of said shaft means in the opposite direction; and means connected to said second housing portion and extending laterally spaced from said shaft means substantially parallel thereto and adapted to engage a fixed abutment adjacent to the threaded connector engaged in said socket means for counteracting said force, said second housing portion having a flat face, said first housing portion projecting beyond said flat face and having a pair of parallel walls respectively provided with openings therethrough aligned along an axis normal to the axis of said piston means, and including means turnably mounting said shaft means in said aligned openings, said means for counteracting said force comprising a plate removably connected to said second housing portion and abutting with a side face thereof against said flat face, said second housing portion being provided at opposite sides thereof adjacent said flat face with a pair of outer ridges extending substantially parallel to the axis of said cylinder and forming a groove therebetween, said plate having a transverse portion engaged in said groove and extending about one of said ridges.*

* * * * *

US004201099B1

REEXAMINATION CERTIFICATE (3766th)

United States Patent [19] [11] B1 4,201,099

Junkers [45] Certificate Issued May 25, 1999

[54] HYDRAULIC WRENCH

[76] Inventor: John K. Junkers, 7 Arrow Head La., Saddle River, N.J. 07458

Reexamination Request:
No. 90/002,889, Nov. 9, 1992

Reexamination Certificate for:

| | |
|---|---|
| Patent No.: | **4,201,099** |
| Issued: | **May 6, 1980** |
| Appl. No.: | **05/933,134** |
| Filed: | **Aug. 14, 1978** |

[51] Int. Cl.[6] ..... B25B 13/46
[52] U.S. Cl. ..... 81/57.39
[58] Field of Search ..... 81/57.3, 57.39

[56] References Cited

U.S. PATENT DOCUMENTS

| | | | |
|---|---|---|---|
| 2,836,090 | 5/1958 | Ray . | |
| 3,759,119 | 9/1973 | Wing . | |
| 4,079,641 | 3/1978 | Junkers | 81/57.39 |
| 4,201,099 | 5/1980 | Junkers . | |

FOREIGN PATENT DOCUMENTS

| | | |
|---|---|---|
| 107550 | 2/1955 | Germany . |
| 2554427 | 12/1975 | Germany . |
| 2631554 | 12/1976 | Germany . |
| 433147 | 2/1966 | Switzerland . |

*Primary Examiner*—James G. Smith

[57] ABSTRACT

A hydraulic wrench comprises an integrally cast housing having a first housing portion and a second elongrated housing portion extending transverse to the first portion and foring a cylinder in which a piston is reciprocably mounted. A shaft extending transverse to the axis of the cylinder is turnably mounted in the first housing portion and carries at one end projecting beyond the housing an exchangeable socket for engaging a polygonal head of a threaded connector to be turned by the wrench. The shaft is turned in one direction during reciprocation of the piston over a ratchet mechanism interconnected between the piston rod and the shaft, whereby during such turning of the shaft and the connector engaged by the socket a force is created tending to turn the housing in the opposite direction. To counteract this force, a plate extending substantially parallel to the shaft is connected to the second housing portion and engages a fixed abutment adjacent the connector to be turned.

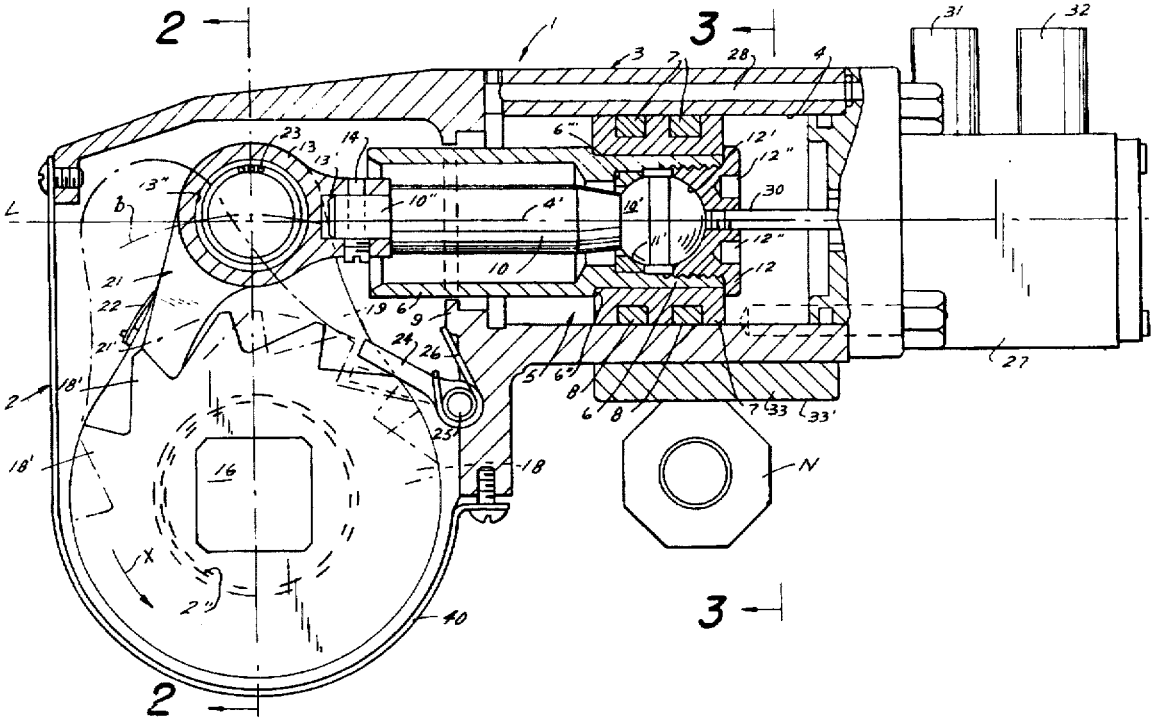

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–14 are cancelled.

New claims 15 and 16 are added and determined to be patentable.

*15. A hydraulic wrench comprising a housing having a first housing portion and an elongated second housing portion extending transverse to said first housing portion and forming a cylinder having an axis extending in the longitudinal direction of said second housing portion; piston means reciprocatable in said cylinder; shaft means having an axis extending transverse to that of said cylinder and being turnably mounted in said first housing portion with an end portion of said shaft means projecting outwardly from said housing; a piston rod connected at one end to said piston means; at least one drive lever mounted in the region of one end turnable about the axis of the shaft means and being pivotally connected at the other end thereof to the other end of said piston rod; a ratchet wheel fixed to said shaft means for rotation therewith; a ratchet pawl on said drive lever and engaging the ratchet wheel to rotate said shaft means upon reciprocation of said piston means in said cylinder; exchangeable socket means mounted on said end portion of said shaft means for engaging a polygonal head of a threaded connector for turning the latter, whereby during such turning of the threaded connector in one direction a force is created tending to turn said housing about the axis of said shaft means in the opposite direction; and means connected to said second housing portion and extending laterally spaced from said shaft means substantially parallel thereto and adapted to engage a fixed abutment adjacent to the threaded connector engaged in said socket means for counteracting said force, said piston means comprising an annular piston slidably mounted in said cylinder and a tubular member having an end portion in said cylinder and projecting from said end portion into said first housing portion, said annular piston being coaxially mounted on said end portion of said tubular member said housing including at the junction of said first and said second housing portion an annular projection in which a portion of said tubular member is slidably guided.*

*16. A hydraulic wrench comprising a housing having a first housing portion and an elongated second housing portion extending transverse to said first housing portion and forming a cylinder having an axis extending in the longitudinal direction of said second housing portion piston means reciprocatable in said cylinder; shaft means having an axis extending transverse to that of said cylinder and being turnably mounted in said first housing portion with an end portion of said shaft means projecting outwardly from said housing; a piston rod connected at one end to said piston means; at least one drive lever mounted in the region of one end turnable about the axis of the shaft means and being pivotally connected at the other end thereof to the other end of said piston rod; a ratchet wheel fixed to said shaft means for rotation therewith; a ratchet pawl on said drive lever and engaging the ratchet wheel to rotate said shaft means upon reciprocation of said piston means in said cylinder; exchangeable socket means mounted on said end portion of said shaft means for engaging a polygonal head of a threaded connector for turning the latter, whereby during such turning of the threaded connector in one direction a force is created tending to turn said housing about the axis of said shaft means in the opposite direction; and means connected to said second housing portion and extending laterally spaced from said shaft means substantially parallel thereto and adapted to engage a fixed abutment adjacent to the threaded connector engaged in said socket means for counteracting said force, said second housing portion having a flat face, said first housing portion projecting beyond said flat face and having a pair of parallel walls respectively provided with openings therethrough aligned along an axis normal to the axis of said piston means, and including means turnably mounting said shaft means in said aligned opening, said means for counteracting said force comprising a plate removably connected to said second housing portion and abutting with a side face thereof against said flat face, said second housing portion being provided at opposite sides thereof adjacent said flat face with a pair of outer ridges extending substantially parallel to the axis of said cylinder and forming a groove therebetween, said plate having a transverse portion engaged in said groove and extending about one of said ridges.*

* * * * *